United States Patent [19]

Oger

[11] 3,996,752

[45] Dec. 14, 1976

[54] CASING PANEL

[75] Inventor: Jacques Oger, Pont-a-Mousson, France

[73] Assignee: Pont-A-Mousson S.A., Nancy, France

[22] Filed: Mar. 19, 1975

[21] Appl. No.: 560,014

[30] Foreign Application Priority Data

Mar. 22, 1974 France ..... 74.10003

[52] U.S. Cl. ..... 61/45 R; 52/245

[51] Int. Cl.[2] ..... E21D 11/14

[58] Field of Search ..... 61/45, 42, 84; 52/245

[56] References Cited

UNITED STATES PATENTS

| | | | |
|---|---|---|---|
| 34,474 | 2/1862 | Bail | 61/45 R |
| 935,376 | 9/1909 | Lennon | 61/45 R |
| 1,125,013 | 1/1915 | Dunlop | 61/45 R |
| 3,483,706 | 12/1969 | Taradash et al. | 61/45 R |
| 3,859,802 | 1/1975 | Platner et al. | 61/45 R |

*Primary Examiner*—Jacob Shapiro
*Attorney, Agent, or Firm*—Sughrue, Rothwell, Mion, Zinn & Macpeak

[57] ABSTRACT

Casing panel comprising voussoirs of the type comprising a web and juxtaposition walls which are substantially perpendicular to the web, wherein two juxtaposed walls, pertaining to two adjacent voussoirs of this panel, define therebetween a cavity for receiving a filling material and have, between said cavity and the outer surface of the webs of the voussoirs, bearing surfaces which are substantially parallel to the direction of the web and bear against each other so as to result in a high pressure drop in the flow of material between the exterior of the webs and the cavity.

5 Claims, 4 Drawing Figures

FIG. 3
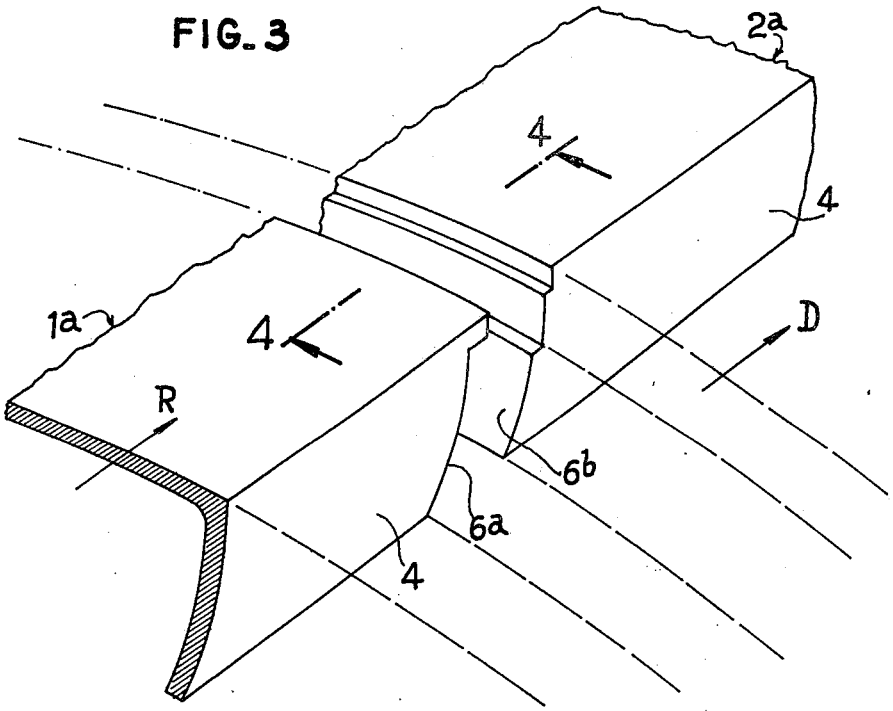
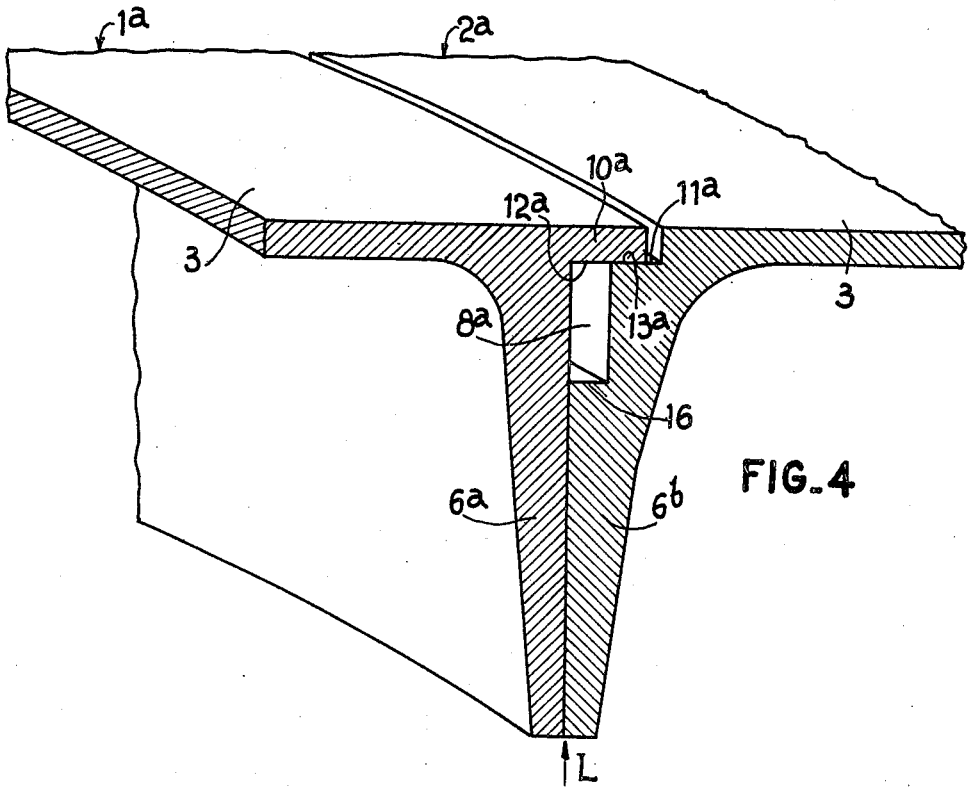
FIG. 4

CASING PANEL

The present invention relates to casing panels comprising voussoirs of the type comprising a web and juxtaposition walls substantially perpendicular to said web.

These voussoirs are in particular employed in the construction of casings or linings, for example of cast iron, for lining tunnels, wells or like underground work and they are interconnected by a connecting material, for example an adhesive, which is introduced between their juxtaposed walls.

Upon assembly of the casing, once the voussoirs are placed in a suitable relative position but before proceeding to the introduction of the connecting material, a filling or packing material, for example cement mortar is usually placed, in the space between the casing and the tunnel or other cavity receiving the casing in order to fill this space. Now, if special precautions are not taken, this introduction of filling material which is for example carried out by injection, may result in infiltrations of the filling material between the walls of the juxtaposed voussoirs in a region which is normally intended to receive the voussoir connecting material.

An object of the present invention is to overcome this drawnback and to avoid the penetration of the filling material which would adversely affect a good subsequent connection between the voussoirs.

According to the invention, there is provided a panel wherein two juxtaposed walls, pertaining to two adjacent voussoirs of this panel, define therebetween a cavity for receiving a filling material and have, between said cavity and the outer surfce of the webs of the voussoirs, bearing surfaces which are substantially parallel to the direction of the web and bear against each other so as to result in a high pressure drop in the flow of material between the exterior of the webs and the cavity.

Thus, irrespective of the distance between the walls of the juxtaposed voussoirs, the precise bearing of the two surfaces against each other opposes the penetration of the filling material when the latter is placed outside the casing.

Further features of the invention will be apparent from the ensuing description with reference to the accompanying drawings given solely by way of example and in which:

FIG. 3 is a view similar to FIG. 1 in respect of two voussoirs adapted to be juxtaposed along their circumferential walls in a cylindrical casing, these walls also being constructed in accordance with the invention, and FIG. 4 is a partial sectional view similar to FIG. 2 and taken on line 4—4 of FIG. 3, of the voussoirs shown in FIG. 3.

Figure 1:
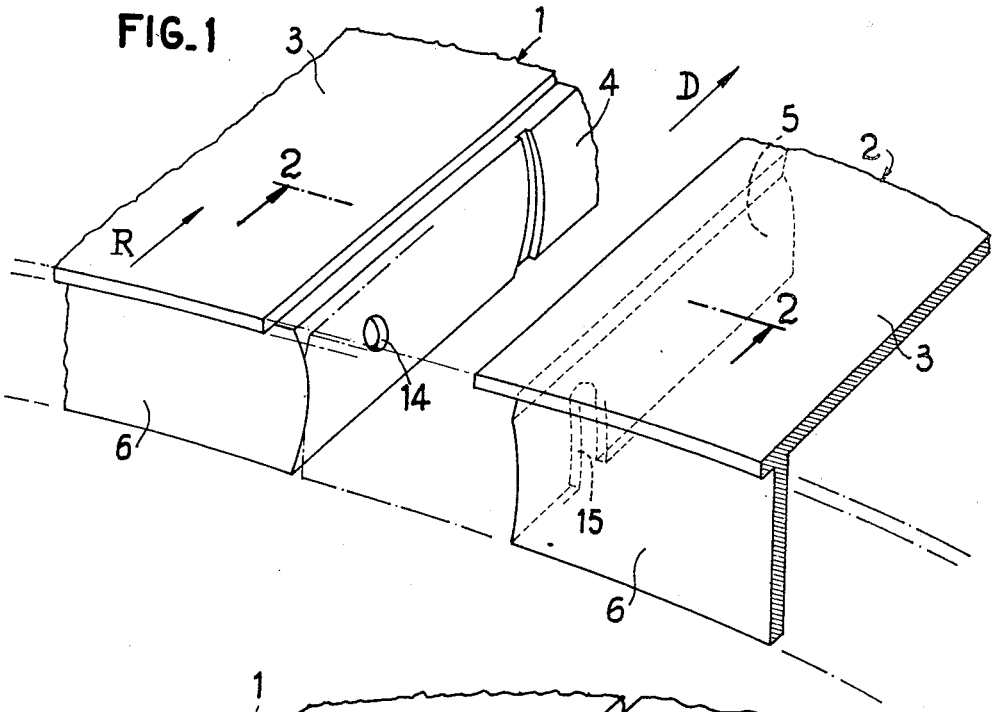
FIG. 1 is a partial perspective view of two voussoirs adapted to be juxtaposed along their longitudinal walls in a cylindrical casing, said walls being constructed in accordance with the invention.
Figure 2:
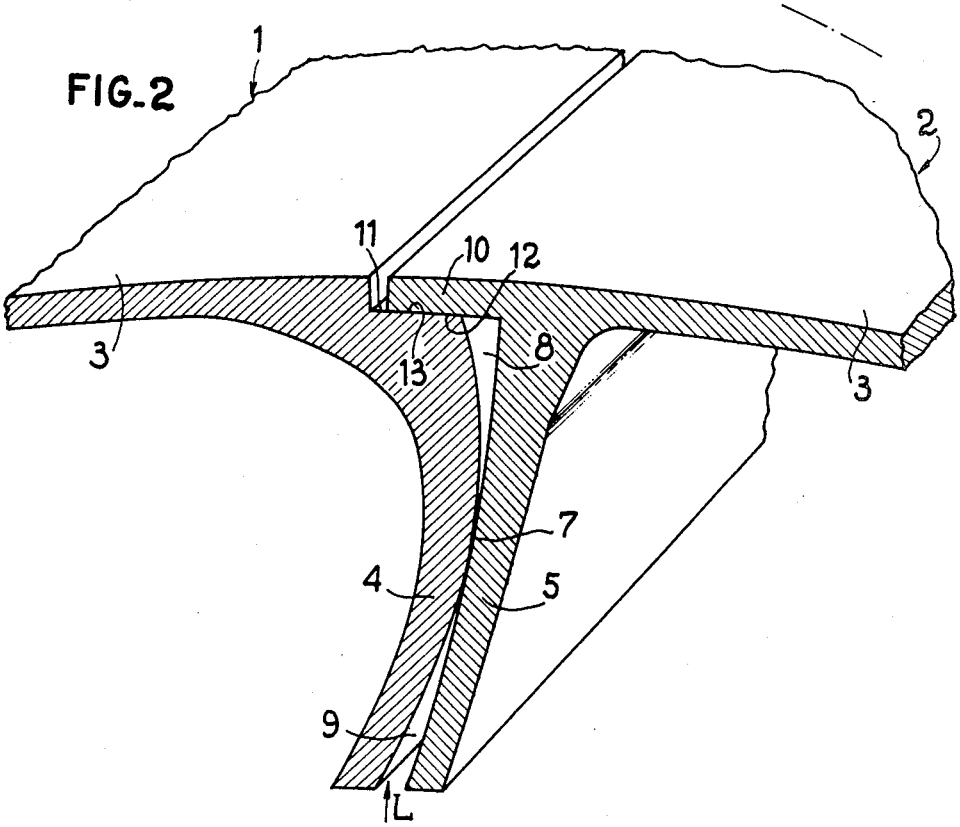
FIG. 2 is a partial perspective view to an enlarged scale of these two voussoirs after having been juxtaposed, the section being taken on line 2—2 of FIG. 1.

The voussoirs 1 and 2 shown in FIGS. 1 and 2 are of cast iron and are intended for constructing a cylindrical casing whose axis corresponds to the direction D. These voussoirs must be juxtaposed in the circumferential direction of the casing. Each one of these voussoirs comprises a web 3 which is in the shape of a portion of a continuous cylinder and is surrounded by a rectangular frame constituted by four juxtaposition walls which are substantially perpendicular to said web and extend toward the axis of the cylinder. Two of these walls 4 and 5 are oriented in the direction D and the other two walls (only one, namely wall 6, has been shown) are oriented in the direction perpendicular to this direction, that is to say circumferentially with respect to the axis of the cylinder. The axial walls 4 and 5 have in the radial direction a slightly curved profile which is convex on one side and concave on the other so as to facilitate the positioning of the voussoirs with respect to each other in the circumferential direction. Further, the curvature of a portion of the surface of the convex wall 4 exceeds the curvature of a portion of the surface of the concave wall 5 so that the surface portions are mismatched, that is to say do not marry up with each other, and, when the surfaces of the walls 4 and 5 of the voussoirs 1 and 2 are brought into contact with each other, they bear against each other in a median axial zone 7 of the two walls. This mismatching or difference of curvature moreover defines a tapering cavity 8 which is divergent in the direction of the webs 3 above or outwardly of the bearing zones 7. For the same reasons a similar tapering cavity 9 is defined between the walls below or inwardly of the bearing zones 7.

The web 3 of each voussoir is extended beyond the concave axial wall 5 by a flange 10 which extends throughout the length of this wall and whose thickness roughly corresponds to the thickness of the web. There is also provided, in the region of the connection between the web 3 and the convex wall 4, an axial shoulder 11 which also extends throughout the length of the wall and whose depth in the radial direction is equal to the thickness of the flange 10, whereas its axial dimension is sufficient to enable it to receive in bearing relation the flange 10 of the neighbouring voussoir when the latter is being supported in the zone 7. The flange 10 bears by its lower planar surface 12 against the planar end wall 13 of the shoulder 11.

The voussoirs just described are assembled in the following manner:

The two voussoirs to be assembled are brought into face-to-face relation, with a convex surface 4 of one of the voussoirs in front of the concave surface 5 of the other and these walls are applied against each other in the zone 7, the flange 10 of the voussoir 2 coming simultaneously in position and bearing against the shoulder 11 of the voussoir 1. If desired, the surfaces 4 and 5 are bolted together, orifices 14 and slots 15 being then provided for this purpose in the walls 4 and 5. Thereafter a mass of filling or packing material, for example containing cement mortar, is injected between the outer surface of the casing constituted by the juxtaposition of the webs 3 of the voussoirs and the wall of the tunnel, in which this casing is placed. The injection is effected from outside the casing on the side of the latter which has not yet been placed in position, for example in the direction R shown in FIG. 1. Finally, a connecting material, such as an adhesive, is injected between the walls 4 and 5 of the voussoirs, this injecting being effected in the direction of the arrow L from inside the casing. This connecting material fills the cavities 8 and 9 defined between the walls 4 and 5 and possibly the whole of the space defined by these walls in the case where the latter would not be in immediate contact with each other.

Thus, the presence of the flange 10 and the shoulder 11 which are bearing against each other opposes any penetration of the exterior filling material into the cavity 8 which must be subsequently occupied by the connecting material. More precisely, if the filling material has a tendency to penetrate between the facing faces of the flange 10 and shoulder 11, the elements of large grain size of this filling material rapidly constitute a barrier opposing further pentration. It could be said that it concerns a lamination of the material which rapidly opposes the advance of the latter.

The voussoirs $1^a$ and $2^a$ shown in FIGS. 3 and 4 are designed to be juxtaposed along the axial direction D by their circumferential walls $6^a$ and $6^b$ which are disposed in facing relation to each other.

The web 3 of each voussoir is extended beyond the wall $6^a$ by a flange $10^a$ which is identical to the flange 10 shown in FIGS. 1 and 2. Likewise, the web has in the region of its connection with the wall $6^b$ a shoulder $11^a$ similar to the shoulder 11 shown in FIGS. 1 and 2, that is to say it is capable of receiving in bearing relation thereon on its flat end wall $13^a$ the flat lower surface $12^a$ of the flange $10^a$ when the surface of the walls $6^a$ and $6^b$ are in contact with each other. These walls have surface which have in the radial direction a prefectly planar shape apart from the flange $10^a$ and the shoulder $11^a$, and a second shoulder 16 which is disposed below or inwardly of the shoulder $11^a$ and is formed in the planar surface of the wall $6^b$. Thus the walls $6^a$ and $6^b$ have surface portions which are mismatched, that is to say do not marry up, so that when the surfaces of the walls $6^a$ and $6^b$ are in contact with each other, this shoulder 16 defines with the facing wall 6 a cavity $8^a$ which extends throughout the length of the walls $6^a$ and $6^b$ of the voussoirs and has a rectangular section.

These voussoirs are assembled in a manner similar to the voussoirs shown in FIG. 2 except that the connecting material occupies the cavity $8^a$ defined by the shoulder 16.

The advantage afforded by the presence of the flange $10^a$ and shoulder $11^a$ is also identical to that of the construction shown in FIGS. 1 and 2.

It will be understood that the two arrangements described hereinbefore respectively for axial walls and circumrential walls may be provided simultaneously on each one of the voussoirs of a casing, the penetration of the filling materials being thus suppressed both in the axial direction and circumferential direction of the casing.

What we claim is:

1. A panel for the construction of a cylindrical casing and comprising an assembly of identical juxtaposed voussoirs each comprising a part-cylindrical four-sided web and four juxtaposition walls which are interconnected and substantially perpendicular to the web, opposite walls of said four walls having outer surfaces comprising a first surface portion and a second surface portion which surface portions extend throughout the length of the corresponding wall, the first surface portions of said opposite walls being mismatching surface portions which do not marry up radially of the web and define therebetween, when the surfaces of said opposite walls pertaining to two adjacent voussoirs in the panel are put in contact with each other in their correct mutual positions in the panel, a cavity extending throughout the length of the corresponding walls for receiving a filling material while said second surface portions define therebetween in a region between said cavity and an outer surface of the webs of the adjacent voussoirs remote from the walls, overlapping bearing surfaces which extend substantially parallel to the direction of the web throughout the length of the corresponding walls and are in mutual bearing relation radially of the web and close off communication between the cavity and said outer surface of the webs.

2. A panel as claimed in claim 1, wherein the two bearing surfaces are flat, one being defined by a shoulder formed in the outer surface of the web of one of the adjacent voussoirs and the other being defined by a flange which is flush with the other surface of the web of the other adjacent voussoir, the depth of the shoulder radially of the panel being equal to the depth of the flange.

3. A panel as claimed in claim 2, wherein the thickness of the flange is substantially equal to the thickness of the web.

4. A panel for the construction of a cylindrical casing and comprising an assembly of identical voussoirs each comprising a part-cylindrical four-sided web and four juxtaposition walls which are interconnected and substantially perpendicular to the web, the four walls being capable, when any two juxtaposed walls of said walls pertaining to two adjacent vosssoirs of the panel are put in contact with each other, of defining therebetween a cavity extending throughout the length of the juxtaposed walls for receiving a filling material and further defining between said cavity and an outer surface of the webs of the adjacent voussoirs remote from the walls, overlapping bearing surfaces which extend substantially parallel to the direction of the web and are in mutual bearing relation radially of the web, wherein in the case where said two walls are walls having a curved profile radially of the panel, the curvature of the convex wall exceeds that of the concave wall so that the cavity is defined by said two walls by the difference in said curvatures and is substantially radially closed on the side of the cavity remote from the two bearing surfaces, by zones of said walls having a curved profile which come in the vicinity of each other.

5. A panel for the construction of a cylindrical casing and comprising an assembly of identical juxtaposed voussoirs each comprising a part-cylindrical four-sided web and four juxtaposition walls which are interconnected and substantially perpendicular to the web, opposite walls of said four walls having outer surfaces comprising a first surface portion and a second surface portion which surface portions extend throughout the length of the corresponding wall, the first surface portions of said opposite walls being mismatching surface portions which do not marry up radially of the web and define therebetween, when the surfaces of said opposite walls pertaining to two adjacent voussoirs in the panel are put in contact with each other in their correct mutual positions in the panel, a cavity extending throughout the length of the corresponding walls for receiving a filling material while said second surface portions define therebetween in a region between said cavity and and outer surface of the webs of the adjacent voussoirs remote from the walls, overlapping bearing surfaces which extend substantially parallel to the direction of the web throughout the length of the corresponding walls and are in mutual bearing relation radially of the web and close off communication between the cavity and said outer surface of the webs, wherein said first surface portions of said opposite walls are planar and said mismatching is the result of a recess which is provided in a single one of said planar surface portions and adjoins said bearing surfaces and defines said cavity which is radially closed on the side of the cavity remote from the bearing surfaces by the planar surface portions which are in contact.

* * * * *